US005178941A

United States Patent [19]

Wu

[11] Patent Number: 5,178,941

[45] Date of Patent: Jan. 12, 1993

[54] PRECAST CONCRETE SLAB AND METHOD OF MAKING SAME

[75] Inventor: Ming-Chien Wu, Taipei Hsien, Taiwan

[73] Assignee: Pao-Sou Lin, Taipei, Taiwan

[21] Appl. No.: 755,738

[22] Filed: Sep. 6, 1991

[51] Int. Cl.[5] ..... B32B 3/26; B32B 13/00

[52] U.S. Cl. ..... 428/309.9; 264/42; 428/312.4; 428/703

[58] Field of Search ..... 264/42; 428/307.3, 307.7, 428/309.9, 312.2, 312.4, 312.6, 703

[56] References Cited

U.S. PATENT DOCUMENTS 4,617,219 10/1986 Schupack ..... 428/703

4,868,039 9/1989 Lehan ..... 428/703

*Primary Examiner*—William J. Van Balen

*Attorney, Agent, or Firm*—Cushman, Darby & Cushman

[57] ABSTRACT

Disclosed is an improved precast concrete slab comprising a slab body formed of a composite of expandable sintered stones, glass fibers, and foam concrete; at least a layer of non-metallic material having pores for filling in the slab body is provided in the middle portion of the slab body; the concrete slab may be molded singly or cut from a pre-molded concrete block formed of the above-mentioned composite materials and having arranged therein a multiplicity of layers of non-metallic material.

8 Claims, 3 Drawing Sheets

PRECAST CONCRETE SLAB AND METHOD OF MAKING SAME

BACKGROUND OF THE INVENTION

The present invention relates to an improved precast concrete slab and a method of making the same.

In reinforced-concrete constructions, concrete is conventionally mixed with water at construction sites, and this process can easily cause dust pollution. Precast concrete slabs are later adopted for forming walls or floors in constructions to reduce dust pollution and to speed up the construction work. But because concrete has a specific weight as high as 2.4 and it easily becomes brittle, when these precast concrete slabs are used in the construction of precast steel buildings, they will cause certain drawbacks:

(1) At present, precast concrete wall slabs or floor slabs in steel buildings weigh as much as several tons a piece and must be mounted in place one by one by means of giant cranes. Using giant cranes in construction work entails high cost and causes noise pollution, and in constructing tall buildings, it is very inconvenient.

(2) To maintain a certain degree of strength, a concrete slab must be very thick; hence, the utilizable space of the upper floors of a tall building becomes less owing to the comparatively greater thickness of the concrete wall slabs used.

(3) In order to support the weight of such bulky wall slabs and floor slabs, a greater load must be taken into consideration when designing the steel skeleton structure of a building; consequently, the steel used must be thicker, and the total weight of the amount of steel required for the whole building is considerable.

(4) The weight of so many tall buildings has an adverse effect on the land.

In regard to the above-mentioned drawbacks in conventional concrete slabs, a prior art sandwich type three-ply concrete slab is an improvement thereon. With reference to FIG. 1, inorganic fibers, cement, and plaster are mixed and pressed to form outer layers 10; then the space between two outer layers 10 is filled with cement and expandable beads such as PU and PE to form the middle layer 11. To enable two adjacent slabs thus formed to couple with each other to form an even plane surface, a notch 12 and a flange are respectively provided in the edges of the middle filler layer.

Although the aforementioned prior art is an improvement on conventional reinforced concrete slabs in terms of weight, fire-proof, sound-proof, and heat insulation, the coupling of two adjacent three-ply slabs is achieved by means of the notch 12 and the flange 13 provided in the middle filler layer, which is the weakest part of the slab. Although such a three-ply slab is comparatively lighter, it is still very bulky, and when using cranes in hoisting or mounting a slab, the flange of the slab is vulnerable to damage, which may affect the proper coupling of two adjacent slabs. Furthermore, the three-ply slab is not integrally formed; therefore, each layer may become detached from each other as time goes by. In addition, because the middle layer is formed of expandable materials, its physical strength is insufficient; hence, further improvement is necessary.

There is also a kind of plaster wall slab used in constructions. It consists chiefly of plaster, which is mixed with asbestos fibers, binding agents, and other fiber materials. But because the plaster slab comprises largely of hollow fibers, its physical strength is very weak. Moreover, it will easily mold if water penetrates into it, since the water moisture inside it cannot easily evaporate.

SUMMARY OF THE INVENTION

It is therefore a primary object of the present invention to provide a method of making an improved precast concrete slab.

It is another object of the present invention to provide an improved concrete slab to eliminate the above-mentioned drawbacks so that it will not cause dust pollution in reinforced-concrete constructions.

It is still another object of the present invention to provide a light-weight but high-strength precast concrete slab which is convenient for use in tall building constructions.

It is yet another object of the present invention to provide a precast concrete slab which has a small thickness and an even surface.

It is a further object of the present invention to provide a precast concrete slab which has low deflection and high flexural rigidity.

It is still a further object of the present invention to provide a precast concrete slab which is fire-proof, sound-proof, and heat-insulated.

It is yet a further object of the present invention to provide a precast concrete slab which can be produced rapidly, and in the process of transportation, hoisting, or mounting, its coupling parts will not be easily damaged.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
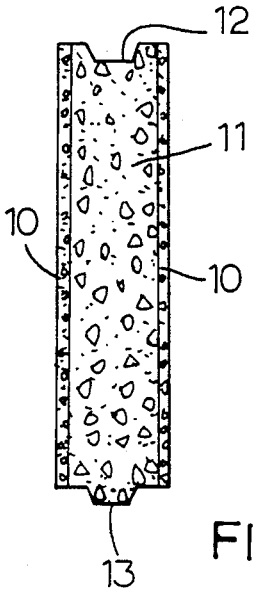
FIG. 1 is a side sectional view of the conventional precast concrete slab.
Figure 2:
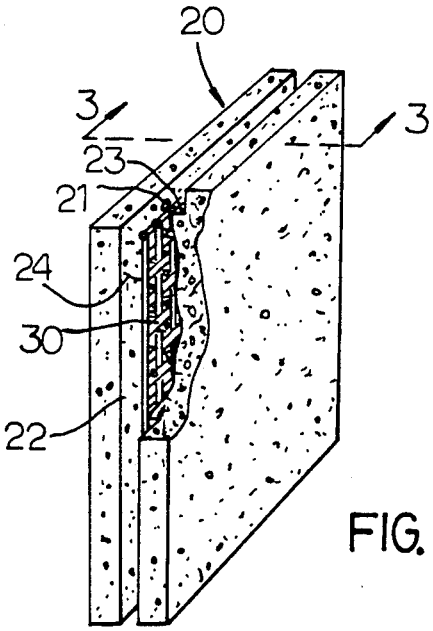
FIG. 2 is a perspective view of an embodiment of the present invention, with a partial section showing the internal structure thereof.
Figure 4:
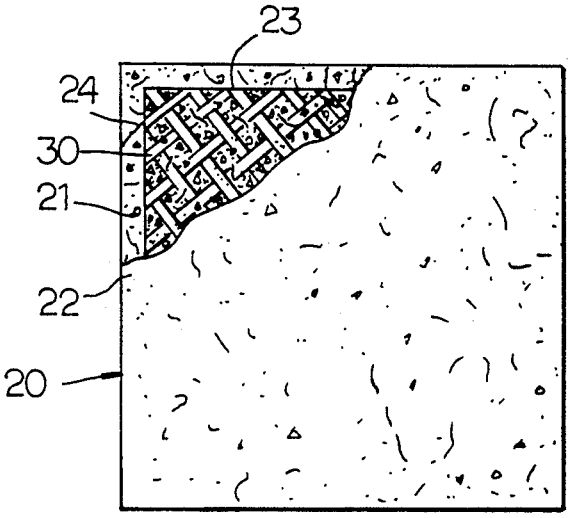
FIG. 4 is a side view of a second preferred embodiment of the present invention.
Figure 5:
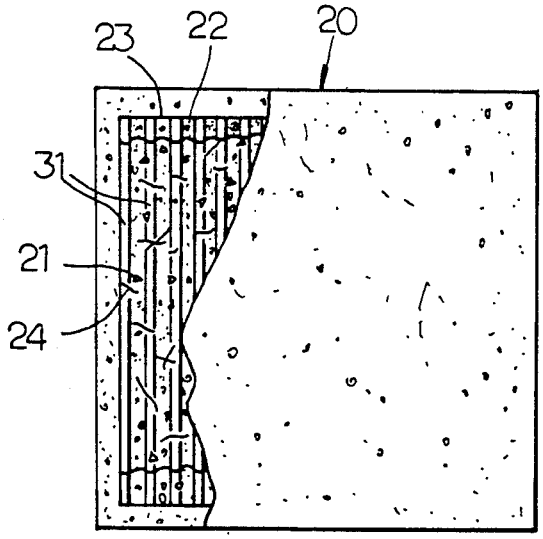
FIG. 5 is a side view of a third preferred embodiment of the present invention.

With reference to the drawings, a slab body 20 according to the present invention consists of light-weight expandable sintered stones 21, which are largely formed of clay heated to 1100 degrees Celsius and then allowed to foam. As a result of sintering at high temperatures, a hard crust is formed on the surface of the stones, and numerous air chambers are formed internally. These air chambers enable the slab body 20 to be light-weight, high-strength, sound-proof, and heat-insulated. The slab body 20 according to the present invention further consists of foam concrete 22 and glass fiber filaments 24. The length of the glass filaments 24 is preferably over 20 m/m so that they can have a better tensile force. Most preferably, the length is 20 m/m to 70 m/m, because if the glass filaments are too long, it will be difficult to mix them with the foam concrete 22. As regards the formation of the foam concrete 22, it is a mixture of cement, sand, expanding agent, and water. The middle of the slab body 20 is provided with at least a layer of porous non-metallic material, which may be a row of non-metallic strips 31 (as shown in FIG. 5), or a non-metallic network such as a reinforced fiber network 30 (as shown in FIG. 4). The non-metallic strips 31 may be fiber strips. Prior to hardening, the composite materials of the slab body 20 penetrate into the pores of the non-metallic material. This structure improves the toughness, shock resistance, and coupling of conventional cement products. The aforementioned reinforced fiber network 30 is formed of non-metallic materials such as fiber reinforced plastics (F.R.P.). As regards the weave of the network 30, it may be a cross weave as in FIGS. 2 and 4, or other arrangements. The specific weight of the slab body 20 according to the present invention can even be maintained at as low as about 0.9–1.0. Even though the slab body 20 has only a thickness of about 50–100 m/m, a wall constituted of the slabs of the present invention has a flexural rigidity greater than any conventional brick walls or plaster walls mounted on light-weight steel. In addition, because the slab body 20 consists of sintered stones, it has excellent fire-proof quality and will not be damaged in a fire accident.

Figure 3:
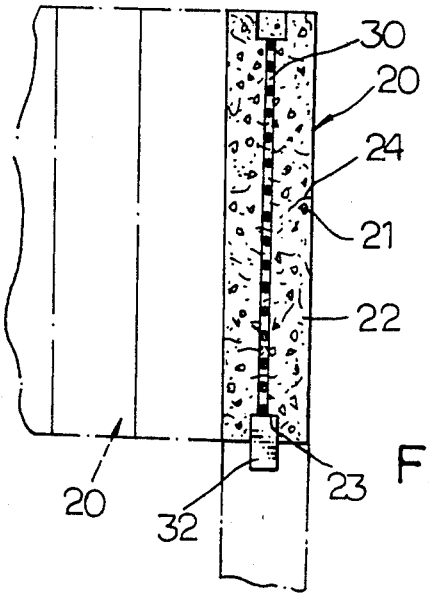
FIG. 3 is a sectional view taken along line 3—3 of FIG. 2.

To secure the coupling of slabs, a groove 23 is provided is each of the sides of the slab body 20. As shown in FIG. 3, when two adjacent slabs are to be coupled, a plate 32 formed of the same material as that of the reinforced fiber network 30 is disposed in each of the grooves 23. Therefore, if synthetic resin is used in coupling two adjacent slabs, the reinforced fiber networks 30 of the slabs and the plate 32 can be glued together integrally. In addition, the gap between two slabs can be filled up with a strong adhesive agent or silicon resin to tightly couple the slabs together. An alternative method is to form holes instead of grooves in the sides of the slab body 20. Those skilled in the art are aware of this and other modifications and it is deemed unnecessary to discuss them in detail herein.

Compared with the conventional reinforced concrete slab as to performance in construction work, in terms of weight, the slab of the present invention has a specific weight of 0.9–1.0, while the conventional slab has a specific weight of 2 4; in terms of thickness, the slab of the present invention has only about half the thickness of the conventional slab, but its tensile strength is no inferior to that of the conventional slab. Hence, when both are of the same tensile strength, the reduction in weight of the slab of the present invention is about 1/5 of the weight of the conventional slab. By using the concrete slabs of the present invention in reinforced concrete constructions, a considerable amount of steel material can be saved, and the space can be more efficiently utilized.

Figure 6:
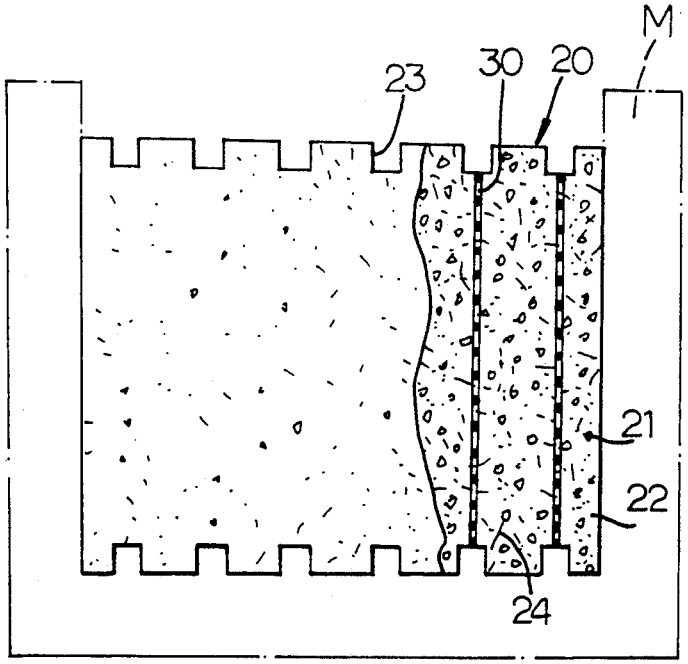
FIG. 6 is a side view of the concrete block formed by using the method of the present invention prior to cutting.

The concrete slab structure according to the present invention may be formed singly or, as shown in FIG. 6, a number of slabs can be cut from a concrete block formed by using the below-described method. A multiplicity of non-metallic networks such as fiber networks 30 (or non-metallic strips 31) are spaced apart at substantially equal distance from each other in a mold M. A fluid composite of expandable sintered stones 21, foam concrete 22, and glass fiber filaments 24 is then poured in the mold M. After hardening, the block thus formed is cut into slabs. This method of forming concrete slabs is fast, and it has never been disclosed in any prior art. It is also obvious that the concrete slabs formed by using this method provide advantages over the aforementioned three-ply slabs. Additionally, in the present invention, the non-metallic material, namely, the non-metallic strips 31 or the fiber networks 30, is accommodated within the middle layer of the slab body 20 formed of expandable sintered stones 21, foam concrete 22, and glass fiber filaments 24, so that the tiny pores in the fiber networks 30 or the tiny spaces between the non-metallic strips 31 are filled with the composite materials of the slab body 20. In this way, the non-metallic material and the slab body 20 are virtually integrally formed, and therefore they will not detach from each other even when dampened.

Although the present invention has been illustrated and described with reference to the preferred embodiments thereof, it should be understood that it is in no way limited to the details of such embodiemnts, but is capable of numerous modifications within the scope of the appended claims.

What is claimed is:

1. An improved precast concrete slab, comprising a slab body and a non-metallic material accommodated within the middle portion of said slab body, said slab body being formed of a composite of a multiplicity of expandable sintered stones, a multiplicity of non-metallic fiber filaments, and foam concrete, at least a layer of said non-metallic material being provided in the middle portion of said slab body, said non-metallic material having a multiplicity of pores filled with the composite materials of said slab body.

2. An improved precast concrete slab according to claim 1, wherein said non-metallic fiber filaments are glass fiber filaments of about 20 m/m to 70 m/m long.

3. An improved precast concrete slab according to claim 1, wherein said slab body has a groove in each of its sides.

4. An improved precast concrete slab according to claim 1, wherein said non-metallic material is a reinforced fiber network.

5. An improved precast concrete slab according to claim 1, wherein said non-metallic material is a row of fiber strips.

6. A method of making an improved precast concrete slab, comprising arranging a multiplicity of layers of non-metallic material at substantially equal distance from each other in a mold, said non-metallic material having a multiplicity of pores; pouring a fluid composite of expandable sintered stones, foam concrete, and glass fiber filaments into said mold so that said fluid composite fill up said mold and said pores of said non-metallic material; allowing said composite to harden; and, cutting the hardened molded composite into slabs.

7. A method according to claim 6, wherein said non-metallic material is a reinforced fiber network.

8. A method according to claim 6, wherein said non-metallic material is a row of fiber strips.

* * * * *